US008092059B2

(12) United States Patent
Yamagata

(10) Patent No.: US 8,092,059 B2
(45) Date of Patent: Jan. 10, 2012

(54) VEHICULAR LIGHTING FIXTURE

(75) Inventor: Shinji Yamagata, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 65 days.

(21) Appl. No.: 12/793,171

(22) Filed: Jun. 3, 2010

(65) Prior Publication Data

US 2010/0309678 A1 Dec. 9, 2010

(30) Foreign Application Priority Data

Jun. 4, 2009 (JP) ..... 2009-135505

(51) Int. Cl.
*F21V 7/04* (2006.01)

(52) U.S. Cl. ..... 362/539; 362/517; 362/518; 362/545; 362/538

(58) Field of Classification Search ..... 362/518, 362/519, 538, 539, 545
See application file for complete search history.

(56) References Cited

U.S. PATENT DOCUMENTS 4,851,968 A * 7/1989 Nino ..... 362/539
6,796,696 B2 * 9/2004 Taniuchi ..... 362/539
6,948,836 B2 9/2005 Ishida et al.
7,186,009 B2 * 3/2007 Yamamura et al. ..... 362/517
7,201,505 B2 * 4/2007 Sugimoto et al. ..... 362/539
7,607,811 B2 * 10/2009 Okada ..... 362/545
7,703,961 B2 * 4/2010 Yatsuda et al. ..... 362/545
2005/0213340 A1 * 9/2005 Suzuki et al. ..... 362/538
2009/0154187 A1 * 6/2009 Kim et al. ..... 362/539
2010/0067249 A1 * 3/2010 Suzuki ..... 362/539
2010/0309679 A1 * 12/2010 Yamagata et al. ..... 362/539

FOREIGN PATENT DOCUMENTS

JP 4080780 B2 2/2008

* cited by examiner

*Primary Examiner* — Anabel Ton
(74) *Attorney, Agent, or Firm* — Kenealy Vaidya LLP

(57) ABSTRACT

A vehicular lighting fixture can include a shade wherein an end edge of an upper surface of the shade is positioned at or in a vicinity of a focus of a projection lens. A first reflection surface can be provided to condense light from a light source in a vicinity of the end edge and to form a basic light distribution pattern by the projection lens. A second reflection surface which can comprise one planar reflection surface and can reflect light from the first reflection surface to form a first additional light distribution pattern. A third reflection surface can be provided on a higher surface of a step section of the upper surface, and can reflect light from the first reflection surface to form a second additional light distribution pattern. A fourth reflection surface can connect the second and third reflection surface, and can reflect the light from the first reflection surface in a direction not incident on the projection lens.

19 Claims, 10 Drawing Sheets

RELATED ART

RELATED ART

RELATED ART

RELATED ART

RELATED ART

VEHICULAR LIGHTING FIXTURE

CROSS-REFERENCE TO RELATED APPLICATIONS

This application claims the priority benefit under 35 U.S.C. §119 of Japanese Patent Application No. 2009-135505 filed on Jun. 4, 2009, which is hereby incorporated in its entirety by reference.

BACKGROUND

1. Field

The presently disclosed subject matter relates to a vehicular lighting fixture, and more particularly to a vehicular lighting fixture capable of preventing a dark zone from being formed in a synthesized light distribution pattern.

2. Description of the Related Art

Conventionally, a vehicular lighting fixture which forms a synthesized light distribution pattern by a plurality of light distribution patterns is known (see, for example, Japanese Patent No. 4080780).

FIG. 6 illustrates an example of a vehicular lighting fixture which forms a synthesized light distribution pattern by a plurality of light distribution patterns. FIG. 7 is a perspective view of a shade used in the vehicular lighting fixture illustrated in FIG. 6.

As illustrated in FIG. 6, a conventional vehicular lighting fixture 200, which forms a synthesized light distribution pattern by a plurality of light distribution patterns, includes a projection lens 210, an LED (light-emitting diode) light source 220, a first reflection surface 230 arranged in the irradiation direction of the LED light source 220, and a shade 240 arranged between the projection lens 210 and the LED light source 220. As illustrated in FIG. 7, the upper surface 241 of the shade 240 includes: an upper stage reflection surface 241*a* corresponding to a shape formed by horizontally extending a first curved end edge e1*a* from the side of the projection lens 210 to the side of the LED light source 220 (in −Z direction); an inclined reflection surface 241*b* corresponding to a shape formed in such a manner that an inclined end edge e1*b*, which extends continuously and obliquely downward from the first curved end edge e1*a*, is horizontally extended from the side of the projection lens 210 to the side of the LED light source 220; and a lower stage reflection surface 241*c* corresponding to a shape formed in such a manner that a second curved end edge e1*c* connected to the inclined end edge e1*b* is horizontally extended from the side of the projection lens 210 to the side of the LED light source 220.

As illustrated in FIG. 6, in the vehicular lighting fixture 200 configured as described above, an irradiation light Ray1 from the LED light source 220 reaches the first reflection surface 230, and is then reflected by the first reflection surface 230, so as to be condensed in the vicinity of the inclined end edge e1*b* of the upper surface 241 of the shade 240. The light Ray 1 then passes through the projection lens 210, so as to form a basic light distribution pattern P0 (see FIG. 9) which has cutoff lines CLa to CLc defined by the projection lens side end edges (the first curved end edge e1*a*, the inclined end edge e1*b*, the second curved end edge e1*b*) and which is wide in the vertical and horizontal directions.

Further, a reflected light beam Ray2 from the first reflection surface 230 reaches the upper stage reflection surface 241*a*, and is then reflected by the upper stage reflection surface 241*a*, and passes through the projection lens 210, so as to form a first additional light distribution pattern P1 (see FIG. 9). The pattern P1 has the cutoff line CLa defined by the first curved end edge e1*a* and which is superimposed on the basic light distribution pattern P0.

Further, the reflected beam Ray2 from the first reflection surface 230 reached the inclined reflection surface 241*b*, and is then reflected by the inclined reflection surface 241*b*, and passes through the projection lens 210, so as to form a second additional light distribution pattern P2 (see FIG. 9). The second distribution pattern has the cutoff line CLb defined by the inclined end edge e1*b* and which is superimposed on the basic light distribution pattern P0.

Further, the reflected light Ray2 from the first reflection surface 230 reaches the lower stage reflection surface 241*c*, and is then reflected by the lower stage reflection surface 241*c*, and passes through the projection lens 210, so as to form a third additional light distribution pattern P3 (see FIG. 9). The third additional light distribution pattern P3 has the cutoff line CLc defined by the second curved end edge e1*c* and which is superimposed on the basic light distribution pattern P0.

As described above, a synthesized light distribution pattern P is formed by the plurality of light distribution patterns P0 to P3 which are respectively formed by the reflection surface 230, and the reflection surfaces 241*a* to 241*c*.

SUMMARY

However, the above described vehicular lighting fixture 200 is configured such that the upper stage reflection surface 241*a* and the lower stage reflection surface 241*c* are respectively arranged on both the left and right sides of the lighting fixture optical axis AX, and such that both the reflection surfaces 241*a* and 241*c*, each of which has a different height position, are connected to each other via the inclined reflection surface 241*b* (see FIG. 7 and FIG. 8). For this reason, as illustrated in FIG. 9, mutually separated individual light distribution patterns P1 and P3 are respectively formed by the upper stage reflection surface 241*a* and the lower stage reflection surface 241*c*. This results in a problem in that a dark zone D (a region having a light intensity lower than the ambient light intensity) is formed in the region between the light distribution patterns P1 and P3 in the synthesized light distribution pattern P (see FIG. 9 and FIG. 10).

The presently disclosed subject matter has been made in view of the above described circumstances. According to one aspect of the presently disclosed subject matter a vehicular lighting fixture can be configured to be capable of preventing a dark zone (a region having a light intensity lower than the ambient light intensity) from being formed in a synthesized light distribution pattern.

To this end, a vehicular lighting fixture, according to the first aspect of the presently disclosed subject matter, can include: a projection lens; a light source; a shade arranged between the projection lens and the light source, wherein an end edge of an upper surface of the shade, the end edge positioned at projection lens side, is positioned at or in a vicinity of a focus of the projection lens; a first reflection surface arranged in an irradiation direction of an irradiation light from the light source and configured such that the irradiation light, which reaches the first reflection surface and is reflected by the first reflection surface, is condensed in a vicinity of the end edge and then passes through the projection lens to form a basic light distribution pattern having a cutoff line defined by the end edge on a projection plane; a second reflection surface which is one planar reflection surface formed on a lower surface of a step section of the upper surface of the shade, the second reflection surface configured such that a reflected light from the first reflection surface, which reaches the second reflection surface and is reflected by the second reflection surface, passes through the projection lens to form a first additional light distribution pattern which has the cutoff line defined by the end edge and is superimposed on the basic light distribution pattern; a third reflection surface formed on a higher surface of the step section of the upper surface of the shade extending along the end edge of the shade, the third reflection surface configured such that the reflected light from the first reflection surface, which reaches the third reflection surface and is reflected by the third reflection surface, passes through the projection lens to form a second additional light distribution pattern which extends along the cutoff line and which is superimposed on the basic light distribution pattern; and a fourth reflection surface formed on the upper surface of the shade, and configured to be inclined obliquely from the third reflection surface to the second reflection surface so as to connect the second and third reflection surface, the fourth reflection surface configured such that the reflected light from the first reflection surface reaches the fourth reflection surface and is reflected by the fourth reflection surface in a direction not incident on the projection lens.

According to the first aspect of the presently disclosed subject matter, the second reflection surface can be configured as one planar reflection surface whose height positions are not different. Thus, the second reflection surface may not form mutually separated individual light distribution patterns as in the conventional case, but can form a single continuous light distribution pattern. Thereby, it is possible to prevent the dark zone form being formed in the synthesized light distribution pattern due to the height position difference between the conventional upper and lower stage reflection surfaces. Further, since the formation of the dark zone can be prevented, it is possible to secure the uniformity of the synthesized light distribution pattern and to improve the visibility in the vicinity of the cutoff line.

Further, according to the first aspect of the presently disclosed subject matter, the increase in the light intensity in the region immediately below the second additional light distribution pattern is suppressed by the effect of the fourth reflection surface. Thus, as compared with the case where the fourth reflection surface is not provided, it is possible to prevent a dark zone from being newly formed due to the light intensity difference between the region immediately below the second additional light distribution pattern and the first additional light distribution pattern.

However, in the case where only the fourth reflection surface is provided, the light intensity in the region immediately below the second additional light distribution pattern may not be increased due to the effect of the fourth reflection surface, and thereby the cutoff line may become unclear.

According to the first aspect of the presently disclosed subject matter, the second additional light distribution pattern, which extends along the cutoff line of the basic light distribution pattern and which is superimposed on the basic light distribution pattern, can be formed by the effect of the third reflection surface. Thus, it is possible to form a synthesized light distribution pattern having a clear cutoff line despite the fact that the light intensity in the region immediately below the second additional light distribution pattern is not increased due to the effect of the fourth reflection surface.

A second aspect of the presently disclosed subject matter is featured in that in the first aspect, the light source is positioned at or in a vicinity of a first focus of the first reflective surface, and the end edge of the shade is positioned at or in the vicinity of a second focus of the first reflective surface.

A third aspect of the presently disclosed subject matter is featured in that in one of the first to second aspects, the second reflection surface is formed on a first region and a second region, to which the upper surface of the shade is divided by a plane including an optical axis of the projection lens thereon and orthogonal to the upper surface. The third and fourth reflection surfaces can be formed on the first region, and the projection lens turn over reflected light reflected by the first to third reflection surfaces in a direction substantially parallel to the upper surface and a direction substantially orthogonal to the upper surface to project the reflected light.

A fourth aspect of the presently disclosed subject matter is featured in that in one of the first to third aspects, the width of the third reflection surface is set to 1 mm or less.

When the width of the third reflection surface is increased, the width of the second additional light distribution pattern is also increased in the vertical direction in correspondence with the increase in the width of the third reflection surface. Thus, when the width of the third reflection surface exceeds 1 mm, a dark zone is newly formed due to the light intensity difference between the vertically expanded second additional light distribution pattern and the first additional light distribution pattern.

According to the second aspect of the presently disclosed subject matter, the width of the third reflection surface is set to 1 mm or less, and hence the width of the second additional light pattern (vertical width) is a minimum width required for the formation of the cutoff line. Thus, it is possible to prevent a dark zone from being newly formed due to the light intensity difference between the second additional light distribution pattern and the first additional light distribution pattern.

A fifth aspect of the presently disclosed subject matter is featured in that in one of the first to fourth aspects, the inclination angle of the fourth reflection surface with respect to the horizontal plane is set in a range of 5 to 30 degrees.

When the inclination angle of the fourth reflection surface with respect to the horizontal plane is less than 5 degrees, the reflected light from the fourth reflection surface is incident on the projection lens so as to cause a dark zone to be newly formed. On the other hand, when the inclination angle of the fourth reflection surface with respect to the horizontal plane is more than 30 degrees, the reflected light from the first reflection surface is shielded by the fourth reflection surface so as to affect the basic light distribution pattern, and the like.

According to the third aspect of the presently disclosed subject matter, since the inclination angle of the fourth reflection surface with respect to the horizontal plane is set in the range of 5 to 30 degrees, it is possible to prevent reflected light from the fourth reflection surface from being incident on the projection lens so as to cause a dark zone to be newly formed, and can also prevent the reflected light from the first reflection surface from being shielded by the fourth reflection surface so as to affect the basic light distribution pattern, and the like.

According to the presently disclosed subject matter, it is possible to provide a vehicular lighting fixture capable of preventing a dark zone (a region having a light intensity lower than the ambient light intensity) from being formed in a synthesized light distribution pattern.

DETAILED DESCRIPTION OF EXEMPLARY EMBODIMENTS

Figure 1:
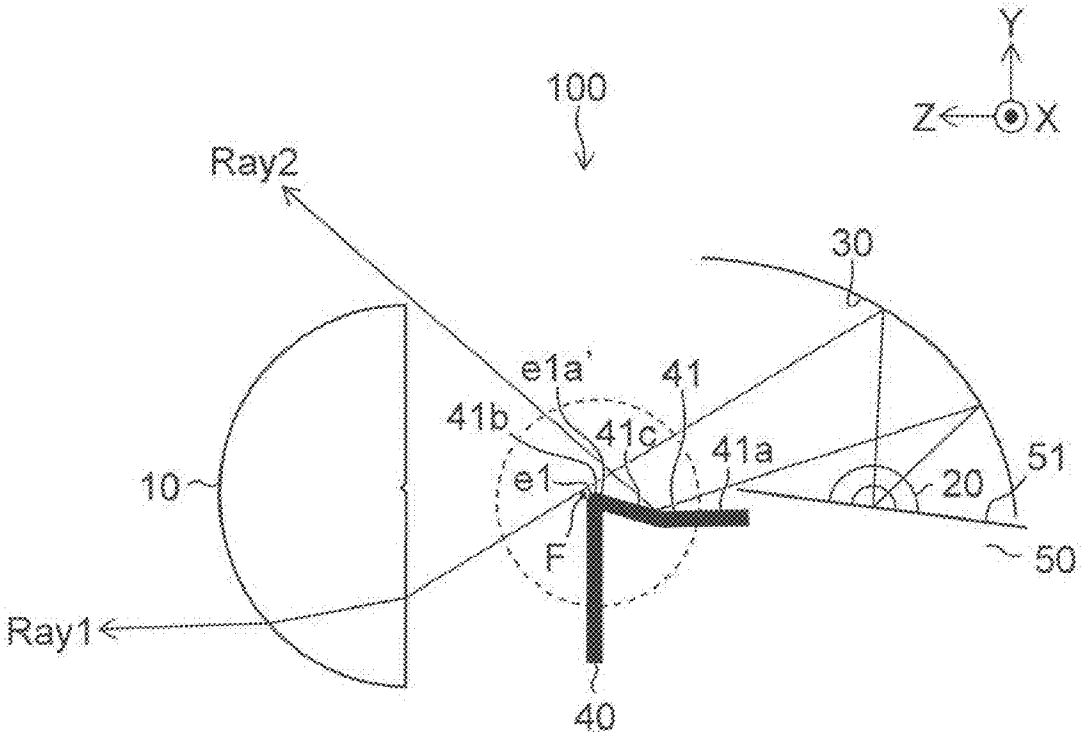
FIG. 1 is a view for explaining a configuration of an example of a vehicular lighting fixture which is made in accordance with principles of the presently disclosed subject matter.

In the following, an example of a vehicular lighting fixture made in accordance with principles of the presently disclosed subject matter, will be described with reference to the accompanying drawings.

A vehicular lighting fixture 100 according to the present exemplary embodiment can be applied to a head lamp of a vehicle, such as a motor vehicle, and can include a projection lens 10 arranged on the front side of the vehicle. An LED light source 20 can be arranged on the rear side of the vehicle, and a first reflection surface 30 can be arranged in the irradiation direction of the LED light source 20. A shade 40 can be arranged between the projection lens 10 and the LED light source 20, as illustrated in FIG. 1.

The projection lens 10 can be configured as a non-spherical condenser lens whose focus F is arranged on the side of the LED light source 20. The projection lens 10 can also be configured to project light along a light emitting axis (for example, along an axis parallel with axis Z and orthogonal to axes X and Y in FIG. 1).

The LED light source 20 is, for example, an LED light source formed by packaging one or more LED chips, and is fixed to, for example, the upper surface 51 of a heat sink 50 so that the light emitting direction is directed in an upward direction (which is exemplified in FIG. 1 as an obliquely upward and rearward direction of the vehicle).

The first reflection surface 30 can be a reflection surface configured such that an irradiation light Ray1 from the LED light source 20, which is reflected by the first reflection surface 30 upon reaching the first reflection surface 30 (see FIG. 1), is condensed in the vicinity of a projection lens side end edge e1 of the upper surface 41 of the shade 40 and then passes through the projection lens 10, so as to form a basic light distribution pattern P0 (see FIG. 4) having cutoff lines CLa to CLc defined by the projection lens side end edge e1. The first reflection surface 30 can also be configured as a rotationally elliptical reflection surface whose first focus is set in the vicinity of the LED light source 20, and whose second focus is set in the vicinity of the center of the projection lens side edge e1 of the upper surface 41 of the shade 40.

The shade 40 can be a member which shields a part of the reflected beam from the first reflection surface 30 to form the cutoff lines, and can be arranged, as illustrated in FIG. 1, between the projection lens 10 and the LED light source 20 in the state where (the approximate center of) the projection lens side end edge e1 of the upper surface 41 of the shade 40 is positioned in the vicinity of the focus F of the projection lens 10.

Figure 2:
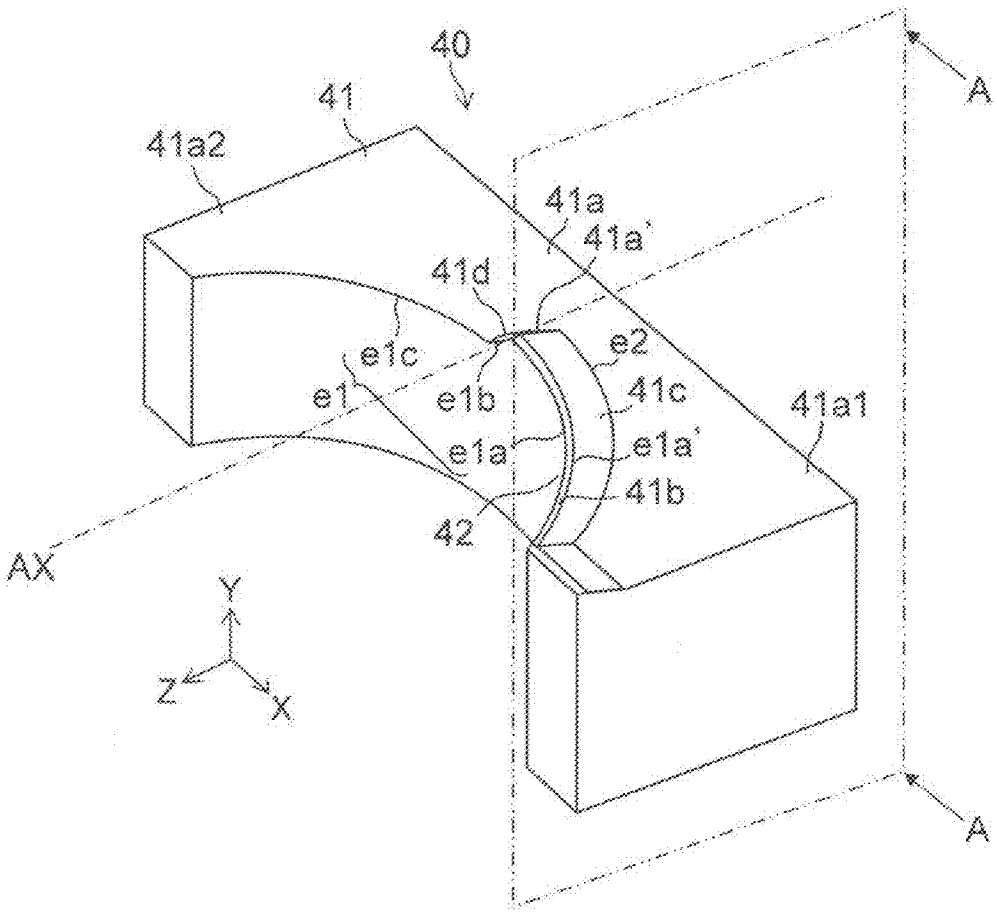
FIG. 2 is a perspective view of a shade used in the vehicular lighting fixture of FIG. 1.

As illustrated in FIG. 2, the upper surface 41 of the shade 40 can include a second reflection surface 41*a*, a third reflection surface 41*b*, a fourth reflection surface 41*c*, and a fifth reflection surface 41*d*.

In order to form clear cutoff lines in consideration of the aberration of the projection lens 10, the projection lens side end edge e1 of the upper surface 41 of the shade 40 can be formed into a substantially circular arc shape which includes a first curved end edge e1*a*, an inclined end edge e1*b* which is connected to the first curved end edge e1*a* and which extends obliquely downward (−Y direction) from the first curved end edge e1*a*, and a second curved end edge e1*c* which is connected to the inclined end edge e1*b*.

The second reflection surface 41*a* can be a reflection surface configured such that the reflected light from the first reflection surface 30, which light is reflected by the second reflection surface 41*a* upon reaching the second reflection surface 41*a*, passes through the projection lens 10 to form a first additional light distribution pattern P1 (see FIG. 4) which has the cutoff-lines CLa to CLc defined by the projection lens side end edge e1 and which is superimposed on the basic light distribution pattern P0. For example, as illustrated in FIG. 1 and FIG. 2, the second reflection surface 41*a* can be configured as one planar reflection surface which is formed in the horizontal plane including the second curved end edge e1*c*. That is, as illustrated in FIG. 2, the second reflection surface 41*a* can be one planar reflection surface which includes reflection surfaces 41*a*1 and 41*a*2 (corresponding to the conventional upper and lower stage reflection surfaces) respectively arranged on both the left and right sides of the axis AX of the lighting fixture, and in which the surface height position is not different between the left and right side reflection surfaces 41*a*1 and 41*a*2.

The third reflection surface 41*b* can be a reflection surface configured such that light reflected from the first reflection surface 30, which is reflected by the third reflection surface 41*b*, passes through the projection lens 10 to form a second additional light distribution pattern P2 (see FIG. 4) which extends along the cutoff line CLa defined by the projection lens side end edge e1 (first curved end edge e1*a*) and which is superimposed on the basic light distribution pattern P0. For example, as illustrated in FIG. 2, the third reflection surface 41*b* can be a planar reflection surface (included in the horizontal plane including the first curved end edge e1*a*) formed on the upper surface of the stepped section 42 which extends along the projection lens side edge e1 (first curved end edge e1*a*) of the upper surface 41 of the shade 40.

The width $\alpha$ of the third reflection surface 41*b* can be a minimum width required for the formation of the cutoff line. When the width a of the third reflection surface 41*b* is increased, the width of the second additional light distribution pattern P2 is also increased in correspondence with the increase in the width $\alpha$. When the width $\alpha$ of the third reflection surface 41*b* exceeds 1 mm, a dark zone may be newly formed due to the light intensity difference between the vertically spread second additional light distribution pattern P2 and the first additional light distribution pattern P1. Therefore, in order to prevent the formation of the new dark zone, the width α of the third reflection surface 41*b* can be set to about 1 mm, and possibly set to 1 mm or less.

The fourth reflection surface 41*c* can be a reflection surface configured such that when a reflected Ray 2 (from the first reflection surface 30) reaches the fourth reflection surface 41*c*, the reflected Ray2 is reflected by the fourth reflection surface 41*c* in a direction that is not incident on the projection lens 10. For example, as illustrated in FIG. 2, and the like, the fourth reflection surface 41*c* can be an inclined reflection surface which is inclined obliquely downward from the end edge e1*a*' on the side opposite to the projection lens side edge e1 of the upper surface (that is, the third reflection surface 41*b*) of the stepped section 42 so as to be connected to the second reflection surface 41*a*.

When the inclination angle β (see FIG. 3) of the fourth reflection surface 41*c* with respect to the horizontal plane (ZX-plane) is less than 5 degrees, the reflected light from the fourth reflection surface 41*c* can be incident on the projection lens 10, to cause a new dark zone. On the other hand, when the inclination angle β exceeds 30 degrees, the reflected light from the first reflection surface 30 can be shielded by the fourth reflection surface 41*c*, to affect the basic light distribution pattern P0, and the like. Therefore, in order to prevent these effects, the inclination angle β (see FIG. 3) of the fourth reflection surface 41*c* with respect to the horizontal plane can be set in the range of 5 to 30 degrees.

The fifth reflection surface 41*d* can be a reflection surface configured such that the reflected light from the first reflection surface 30, which light is reflected by the fifth reflection surface 41*d*, passes through the projection lens 10 to form a third additional light distribution pattern P3 (see FIG. 4) which extends along the inclined cutoff line CLb defined by the projection lens side end edge e1 (inclined end edge e1*b*), and which is superimposed on the basic light distribution pattern P0. For example, as illustrated in FIG. 2, the fifth reflection surface 41*d* can be an inclined reflection surface which is inclined obliquely downward from an end section 41*a*' of the second reflection surface 41*a* so as to be connected to the second reflection surface 41*a*. The fifth reflection surface 41*d* corresponds to a reflection surface which is formed by horizontally extending the inclined end edge e1*b* of the upper surface 41 of the shade 40 to the side of the LED light source 20 by a predetermined amount.

In the vehicular lighting fixture 100 configured as described above, as illustrated in FIG. 1, the irradiation light Ray1 from the LED light source 20 can be reflected by the first reflection surface 30 upon reaching the first reflection surface 30, so as to be condensed in the vicinity of the projection lens side end edge e1 of the upper surface 41 of the shade 40 (condensed at the second focus of the first reflection surface 30), and can then pass through the projection lens 10, so as to form the basic light distribution pattern P0 (see FIG. 4) which has the cutoff lines CLa to CLc defined by the projection lens side end edge e1 and which is wide in the vertical and horizontal directions.

Figure 9:
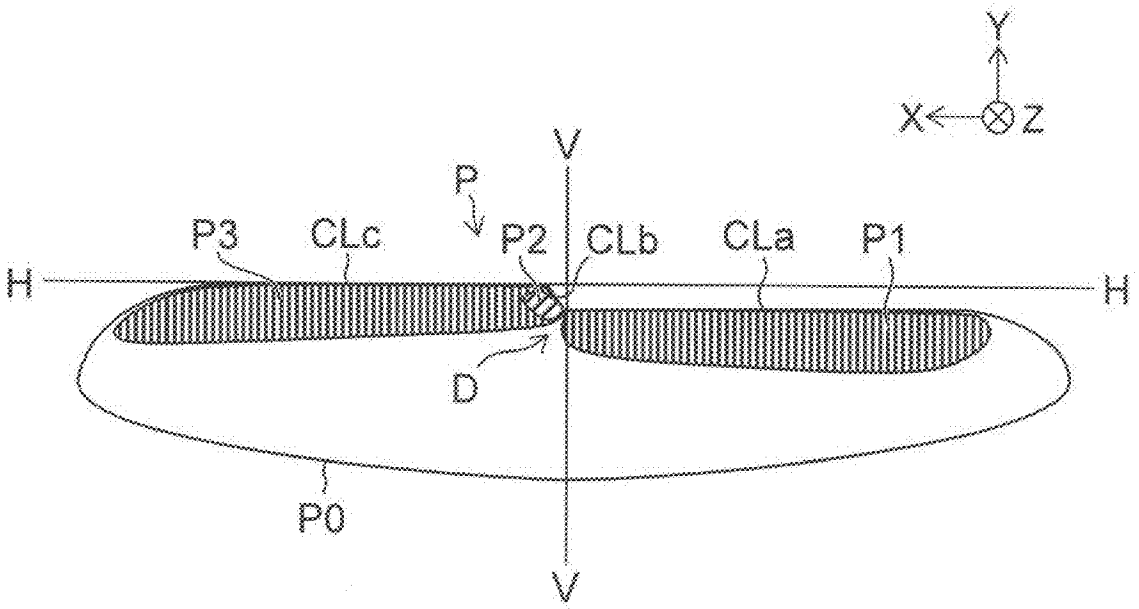
FIG. 9 illustrates an example of a synthesized light distribution pattern P formed by the conventional vehicular lighting fixture of FIG. 6 on a vertical screen arranged at a predetermined position.
Figure 10:
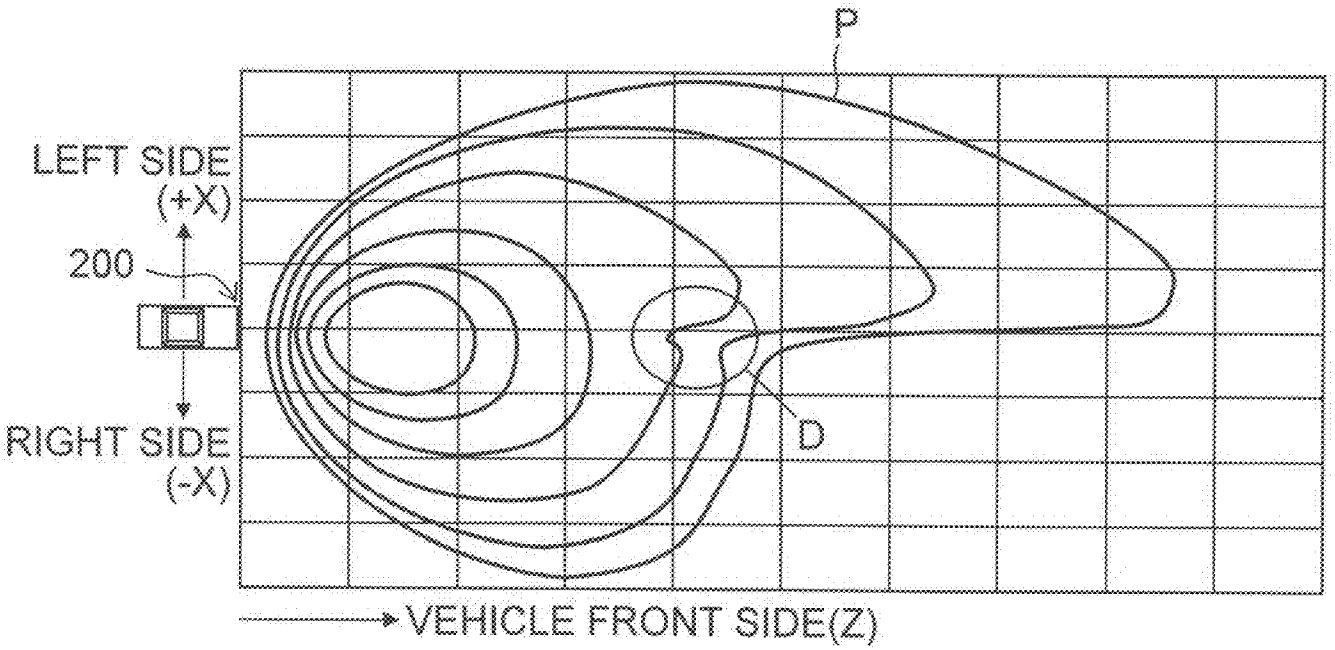
FIG. 10 illustrates an example of a synthesized light distribution pattern P formed on the road by the conventional vehicular lighting fixture of FIG. 6.

The reflected light from the first reflection surface 30 can be further reflected by the second reflection surface 41*a* upon reaching the second reflection surface 41*a*, and can pass through the projection lens 10 to form the first additional light distribution pattern P1 (see FIG. 4) which has cutoff lines CLa to CLc defined by the projection lens side end edge e1 and which is superimposed on the basic light distribution pattern P0. The second reflection surface 41*a* (corresponding to the conventional upper and lower stage reflection surfaces) can be one planar reflection surface whose height positions (Y coordinate) are not different (see FIG. 2 and FIG. 3). Thus, the second reflection surface 41*a* may not form the individual light distribution patterns (see FIG. 9) separated into the left and right sides, but can form a single light distribution pattern P1 (see FIG. 4) that is continuous in the left and right directions (X direction). Thus, it is possible to prevent a dark zone form being formed in a synthesized light distribution pattern P (see FIG. 4) due to the height position difference between the conventional upper and lower stage reflection surfaces (see FIG. 4 and FIG. 5).

Further, the reflected light from the first reflection surface 30 can be reflected by the third reflection surface 41*b*, and can pass through the projection lens 10 to form the second additional light distribution pattern P2 (see FIG. 4) which extends along the cutoff line CLa defined by the projection lens side end edge e1 (first curved end edge e1*a*) and which is superimposed on the basic light distribution pattern P0. By the effect of the third reflection surface 41*b*, it is possible to form the synthesized light distribution pattern P (see FIG. 4) having the clear cutoff line CLa.

Further, as illustrated in FIG. 1, upon reaching the fourth reflection surface 41*c*, the reflected light Ray2 from the first reflection surface 30 can be reflected by the fourth reflection surface 41*c* in a direction that is not incident on the projection lens 10. The increase in the light intensity in the region A (see FIG. 4) immediately below the second additional light distribution pattern P2 can be suppressed by the effect of the fourth reflection surface 41*c*. Thus, as compared with the case where the fourth reflection surface 41*c* is not provided, it is possible to prevent a dark zone from being newly formed due to the light intensity difference between the region A immediately below the second additional light distribution pattern P2 and the first additional light distribution pattern P1.

Further, upon reaching the fifth reflection surface 41*d*, the reflected light from the first reflection surface 30 can be reflected by the fifth reflection surface 41*d*, and can pass through the projection lens 10 to form the third additional light distribution pattern P3 (see FIG. 4) which extends along the oblique cutoff line CLb defined by the projection lens side end edge e1 (inclined end edge e1*b*), and which is superimposed on the basic light distribution pattern P0. By the effect of the fifth reflection surface 41*d*, it is possible to form a synthesized light distribution pattern P having the clear oblique cutoff line CLb (see FIG. 4).

Figure 4:
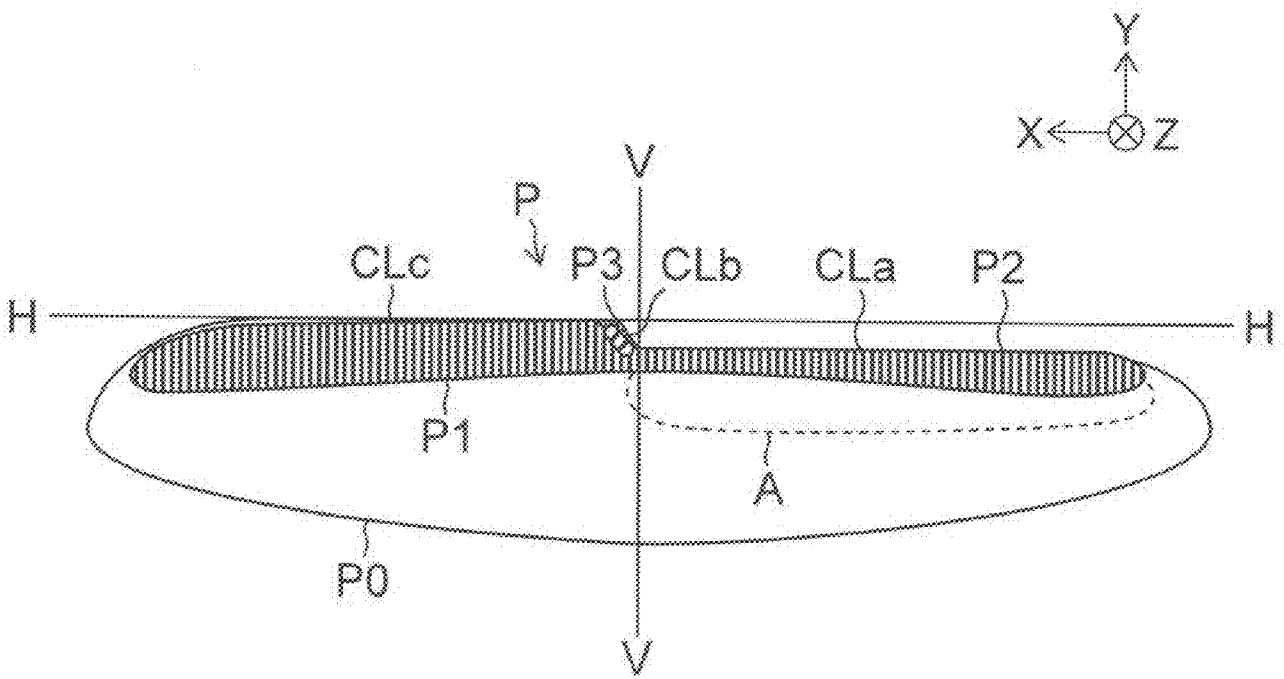
FIG. 4 illustrates an example of a synthesized light distribution pattern P formed by the vehicular lighting fixture of FIG. 1 on a vertical screen arranged at a predetermined position.
Figure 5:
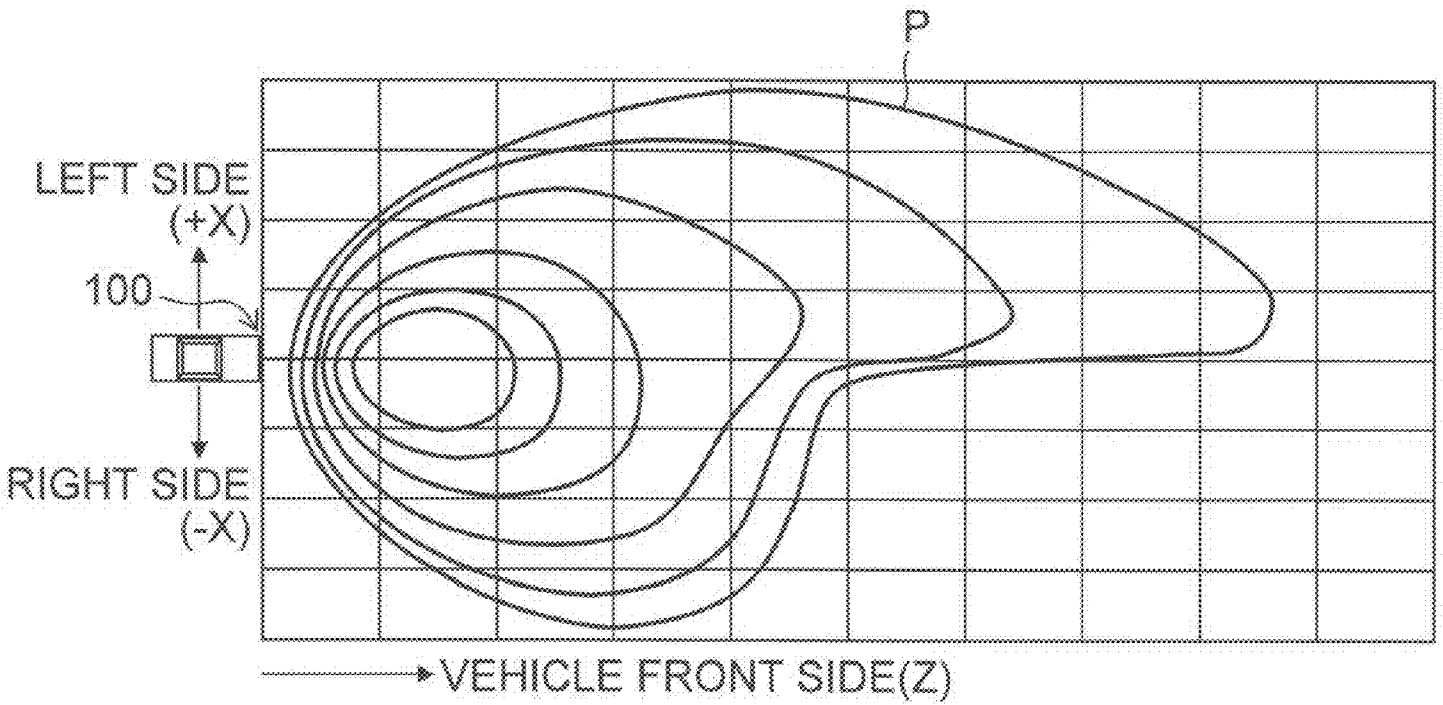
FIG. 5 illustrates an example of a synthesized light distribution pattern P formed on the road by the vehicular lighting fixture of FIG. 1.
Figure 6:
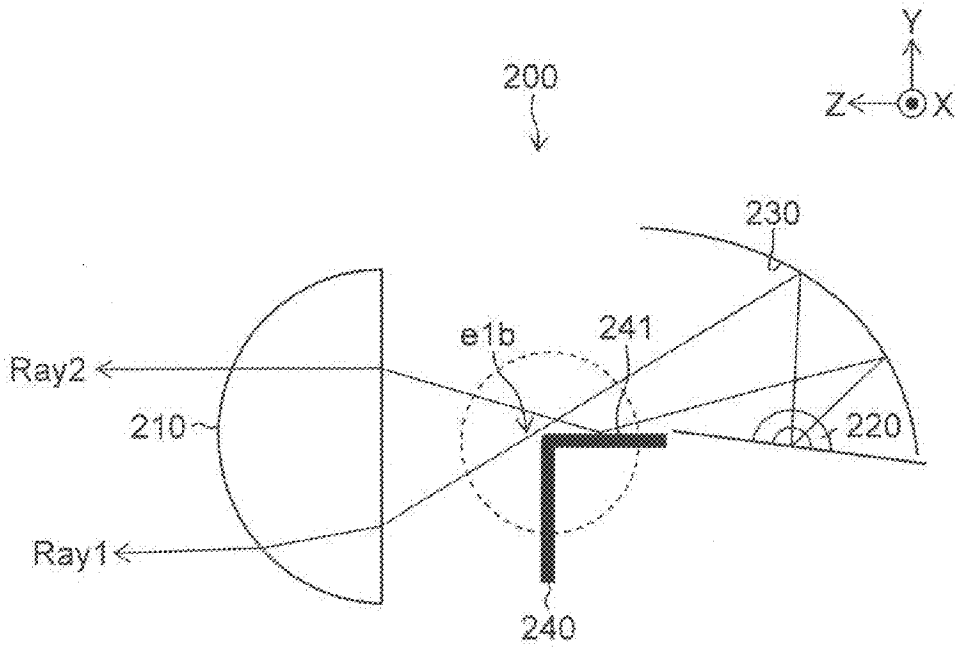
FIG. 6 is a view for explaining a configuration of a conventional vehicular lighting fixture.
Figure 7:
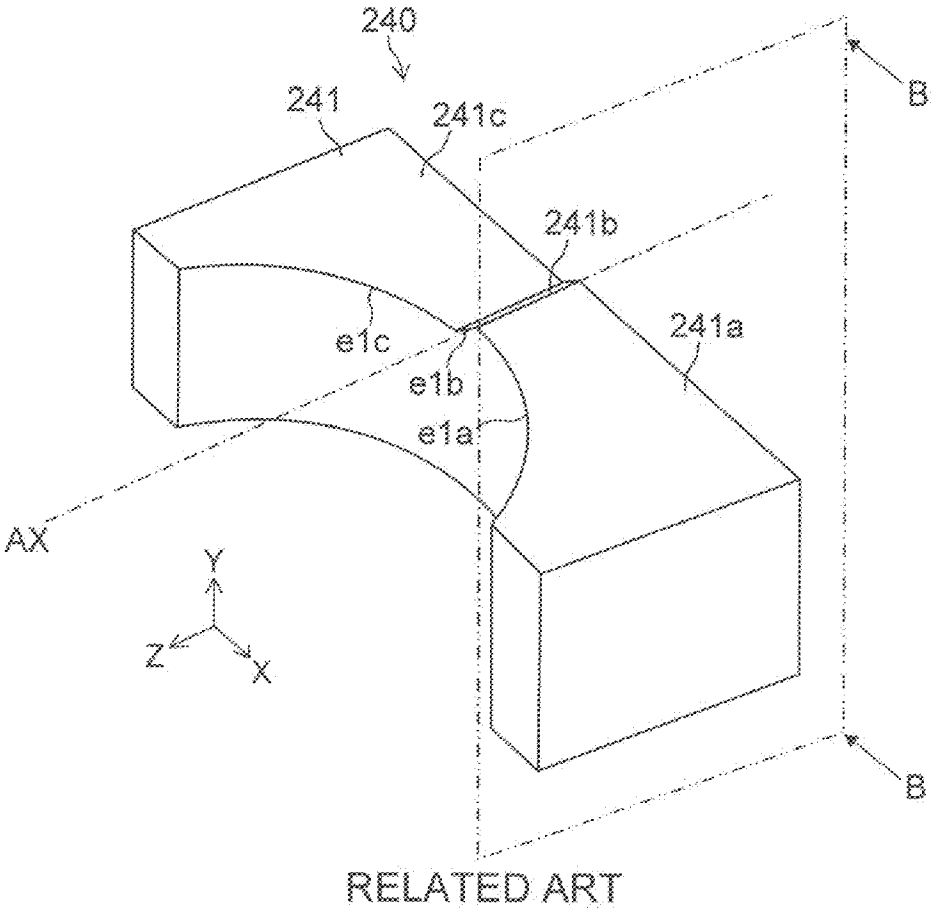
FIG. 7 is a perspective view of a shade used in the conventional vehicular lighting fixture of FIG. 6.
Figure 8:
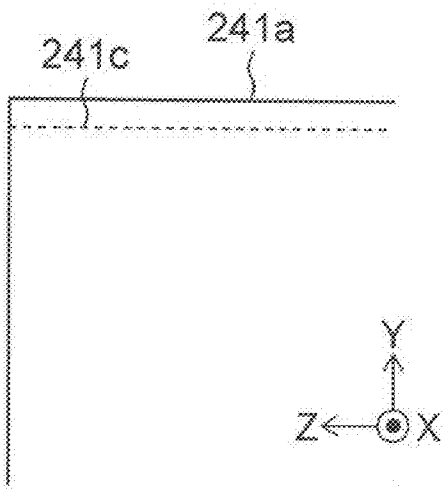
FIG. 8 is an enlarged view (lateral view taken along line B-B in FIG. 7) of the range surrounded by the dotted circle in FIG. 6.

As described above, the synthesized light distribution pattern P can be formed by the respective light distribution patterns P0 to P3 which are respectively formed by the reflection surface 30, and the reflection surfaces 41*a* to 41*d* (see FIG. 4).

Figure 3:
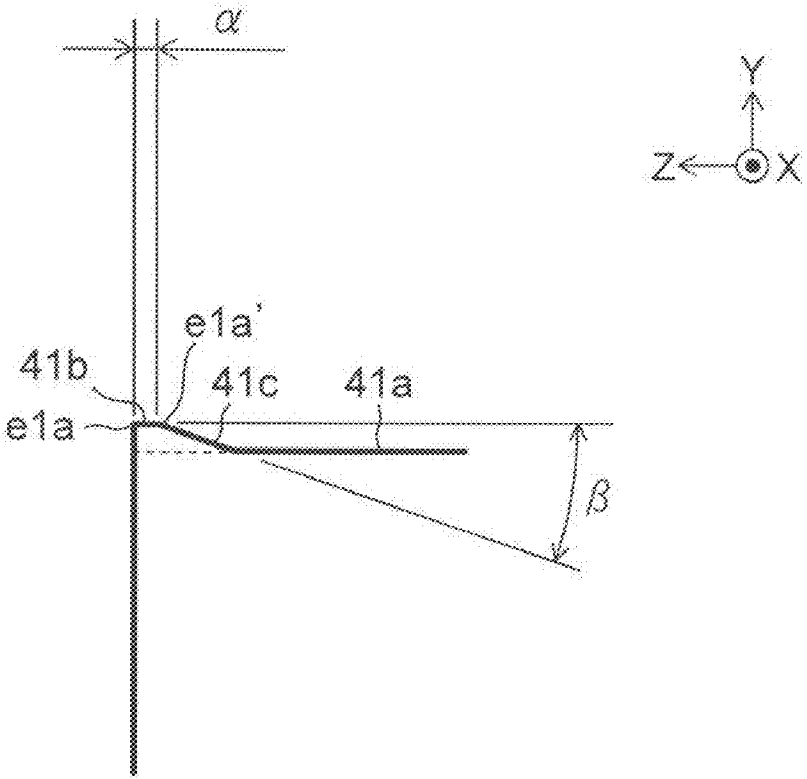
FIG. 3 is an enlarged view (lateral view taken along line A-A in FIG. 2) of the range surrounded by the dotted circle in FIG. 1.

As described above, according to the present embodiment, the second reflection surface 41*a* can be configured as one planar reflection surface whose height positions are not different (see FIG. 2 and FIG. 3). Thus, the second reflection surface 41*a* can be prevented from forming the individual light distribution patterns separated into left and right sides (along X direction), but can form a single light distribution pattern P1 (see FIG. 4). Thus, it is possible to prevent a dark zone from being formed in the synthesized light distribution pattern P (see FIG. 4) due to the height position difference between the conventional upper and lower stage reflection surfaces (see FIG. 4 and FIG. 5). Further, since the formation of the dark zone can be prevented, it is possible to secure the uniformity of the synthesized light distribution pattern P (see FIG. 4) and to improve the visibility in the vicinity of the cutoff line CLa.

Further, according to the present embodiment, the increase in the light intensity in the region A (see FIG. 4) immediately below the second additional light distribution pattern P2 is suppressed by the effect of the fourth reflection surface 41*c*.

Thus, as compared with the case where the fourth reflection surface 41*c* is not provided, it is possible to prevent that the dark zone from being newly formed due to the light intensity difference between the region A immediately below the second additional light distribution pattern P2 and the first additional light distribution pattern P1.

However, when only the fourth reflection surface 41*c* is provided, the light intensity in the region A immediately below the second additional light distribution pattern P2 may not be increased by the effect of the fourth reflection surface 41*c* and thereby the cutoff line CLa may become unclear.

According to the present embodiment, the second additional light distribution pattern P2, which extends along the cutoff line CLa of the basic light distribution pattern P0 and which is superimposed on the basic light distribution pattern P0, is formed by the effect of the third reflection surface 41*b*. Thus, it is possible to form, by the action of the fourth reflection surface 41*c*, the synthesized light distribution pattern P (see FIG. 4) having the clear cutoff line CLa despite the fact that the light intensity in the region A immediately below the second additional light distribution pattern P2 is not increased.

Further, according to the present embodiment, the width $\alpha$ of the third reflection surface 41*b* can be set to 1 mm or less, and hence the width (vertical width) of the second additional light distribution pattern P2 can be a minimum width required for the formation of the cutoff line CLa. Thus it is possible to prevent that the dark zone from being newly formed due to the light intensity difference between the second additional light distribution pattern P2 and the first additional light distribution pattern P1.

Further, according to the present embodiment, the inclination angle of the fourth reflection surface 41*c* with respect to the horizontal plane can be set in the range of 5 to 30 degrees. Thus, it is possible to prevent the reflected beam from the fourth reflection surface 41*c* that is incident on the projection lens 10 from causing a new dark zone to be formed, and to prevent the reflected light from the first reflection surface 30 from being shielded by the fourth reflection surface 41*c* to affect the basic light distribution pattern P0, and the like.

Next, modifications of the present embodiment will be described.

In the above described embodiment, an example provided with the fifth reflection surface 41*d* is described, but the presently disclosed subject matter is not limited to this. The fifth reflection surface 41*d* may be omitted or shaped differently, as desired.

In the above described embodiment, an example of a vehicular lighting fixture 100, which is applied to the case of left-hand traffic, is described, but the presently disclosed subject matter is not limited to this. It is possible to apply the shade 40 illustrated in FIG. 2 to the case of right-hand traffic by reversing the left and right sides of the shade 40. In other words, a shade having a shape that is a reflected image (a mirrored image of) the shade 40 with respect to YZ-plane can be applied to the case of right-hand traffic.

All the points of the above described embodiment are only examples. The presently disclosed subject matter should not be construed as being limited by the description of these examples. The presently disclosed subject matter can be carried out in other various forms without departing from the spirit or scope of the presently disclosed subject matter.

What is claimed is:

1. A vehicular lighting fixture having a light emitting axis, comprising:

a projection lens having a focus;

a light source configured to emit irradiation light in an irradiation direction;

a shade located between the projection lens and the light source, the shade including an upper surface and an end edge facing towards the projection lens, wherein the end edge of the upper surface of the shade is located substantially at the focus of the projection lens;

a first reflection surface located in the irradiation direction of the irradiation light emitted from the light source and configured such that at least a portion of the irradiation light is reflected by the first reflection surface and is condensed substantially at the end edge of the shade and then passes through the projection lens to form a basic light distribution pattern having a cutoff line defined by the end edge on a projection plane;

a second reflection surface includes one planar reflection surface formed on a lower surface of a step section of the upper surface of the shade, the second reflection surface configured such that at least a portion of light reflected from the first reflection surface is reflected by the second reflection surface and passes through the projection lens to form a first additional light distribution pattern which has the cutoff line defined by the end edge and is superimposed on the basic light distribution pattern;

a third reflection surface located on a higher surface of the step section of the upper surface of the shade and extending along the end edge of the shade, the third reflection surface configured such that at least a portion of light reflected from the first reflection surface is reflected by the third reflection surface and passes through the projection lens to form a second additional light distribution pattern which extends along the cutoff line and which is superimposed on the basic light distribution pattern; and a fourth reflection surface located on the upper surface of the shade and inclined obliquely from the third reflection surface to the second reflection surface so as to connect the second reflection surface and third reflection surface, the fourth reflection surface configured such that at least a portion of light reflected from the first reflection surface is reflected by the fourth reflection surface in a direction not incident on the projection lens.

2. The vehicular lighting fixture according to claim 1, wherein the light source is positioned substantially at a first focus of the first reflection surface, and the end edge of the shade is positioned substantially at a second focus of the first reflection surface.

3. The vehicular lighting fixture according to claim 2, wherein the upper surface of the shade is divided into a first region and a second region by a plane including an optical axis of the projection lens, the plane being orthogonal to the upper surface, the second reflection surface is formed on the first region and the second region, the third reflection surface and fourth reflection surface are formed on the first region, and the projection lens turns over reflected light from the first, second, and third reflection surfaces in a direction substantially parallel to the upper surface and projects the reflected light.

4. The vehicular lighting fixture according to claim 1, wherein the width of the third reflection surface is 1 mm or less.

5. The vehicular lighting fixture according to claim 1, wherein the inclination angle of the fourth reflection surface with respect to a horizontal surface containing the light emitting axis is in a range of 5 to 30 degrees.

6. The vehicular lighting fixture according to claim 1, wherein when viewed in cross section from a direction orthogonal to the light emitting axis, the second reflection surface extends in a substantially linear fashion and is connected directly to the fourth reflection surface at a connection joint, the fourth reflection surface extends substantially linearly from the connection joint with the second reflection surface and at an oblique angle with respect to the second reflection surface and is connected directly to the third reflection surface at a second connection joint, and the third reflection surface extends substantially linearly from the second connection joint with the fourth reflection surface to form the end edge.

7. The vehicular lighting fixture according to claim 6, wherein the third reflection surface connects to a front facing surface of the shade at a location that is 1 mm or less from the fourth reflection surface, the front facing surface being substantially orthogonal to the third reflection surface.

8. The vehicular lighting fixture according to claim 6, further comprising a fifth reflection surface connecting the end edge of a right portion of the shade to the end edge of a left portion of the shade, the fifth reflection surface configured at an angle with respect to each of the second reflection surface, the third reflection surface, and the fourth reflection surface.

9. The vehicular lighting fixture according to claim 1, wherein the third reflection surface terminates and forms an end edge of the shade, the end edge is located 1 mm or less from the fourth reflection surface.

10. The vehicular lighting fixture according to claim 1, wherein the inclination angle of the fourth reflection surface with respect to the third reflection surface is in a range of 5 to 30 degrees.

11. The vehicular lighting fixture according to claim 1, wherein the inclination angle of the fourth reflection surface with respect to the second reflection surface is in a range of 5 to 30 degrees.

12. The vehicular lighting fixture according to claim 4, wherein the width of the third reflection surface is taken along a direction parallel with the light emitting axis.

13. The vehicular lighting fixture according to claim 1, wherein the light source is an LED light source.

14. A vehicular lighting device comprising:

a light source configured to emit irradiation light in an irradiation direction;

a projection lens having a focus and configured to project light received from the light source along a light emitting axis;

a shade located between the projection lens and the light source, the shade including an upper surface and an end edge facing towards the projection lens, wherein the end edge of the upper surface of the shade is located substantially at the focus of the projection lens; and a first reflection surface located in the irradiation direction of the irradiation light emitted from the light source and configured such that at least a portion of the irradiation light is reflected by the first reflection surface and is condensed substantially at the end edge of the shade and then passes through the projection lens to form a basic light distribution pattern having a cutoff line defined by the end edge on a projection plane, wherein the shade includes a second reflection surface, a third reflection surface, and a fourth reflection surface, and when viewed in cross section the second reflection surface extends in a substantially linear fashion and is connected directly to the fourth reflection surface at a connection joint, the fourth reflection surface extends substantially linearly from the connection joint with the second reflection surface and at an oblique angle with respect to the second reflection surface and is connected directly to the third reflection surface at a second connection joint, and the third reflection surface extends from the second connection joint with the fourth reflection surface to the end edge of the shade.

15. The vehicular lighting device of claim 14, wherein the second reflection surface includes one planar reflection surface formed on a lower surface of a step section of the upper surface of the shade, the second reflection surface configured such that at least a portion of light reflected from the first reflection surface is reflected by the second reflection surface and passes through the projection lens to form a first additional light distribution pattern which has the cutoff line defined by the end edge and is superimposed on the basic light distribution pattern;

the third reflection surface is located on a higher surface of the step section of the upper surface of the shade and extends along the end edge of the shade, the third reflection surface configured such that at least a portion of light reflected from the first reflection surface is reflected by the third reflection surface and passes through the projection lens to form a second additional light distribution pattern which extends along the cutoff line and which is superimposed on the basic light distribution pattern; and the fourth reflection surface is located on the upper surface of the shade and is inclined obliquely from the third reflection surface to the second reflection surface so as to connect the second reflection surface and third reflection surface, the fourth reflection surface configured such that at least a portion of light reflected from the first reflection surface is reflected by the fourth reflection surface in a direction not incident on the projection lens.

16. The vehicular lighting fixture according to claim 14, wherein the light source is positioned substantially at a first focus of the first reflection surface, and the end edge of the shade is positioned substantially at a second focus of the first reflection surface.

17. The vehicular lighting fixture according to claim 14, wherein the upper surface of the shade is divided into a first region and a second region by a plane including an optical axis of the projection lens, the plane being orthogonal to the upper surface, the second reflection surface is formed on the first region and the second region, the third reflection surface and fourth reflection surface are formed on the first region such that a portion of the end edge located at the first region is shaped differently from a portion of the end region located at the second region.

18. The vehicular lighting fixture according to claim 14, wherein third reflection surface has a width of 1 mm or less as taken in cross section.

19. The vehicular lighting fixture according to claim 14, wherein the angle of the fourth reflection surface with respect to the second reflection surface is in a range of 5 to 30 degrees.

* * * * *